US009366069B2

(12) United States Patent
Dayton

(10) Patent No.: US 9,366,069 B2
(45) **Date of Patent: *Jun. 14, 2016**

(54) DEVICE FOR ENHANCING A CORNER STRUCTURE

(71) Applicant: Connie M. Dayton, Ft. Worth, TX (US)

(72) Inventor: Connie M. Dayton, Ft. Worth, TX (US)

(73) Assignee: Connie M. Dayton, Ft. Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/706,705

(22) Filed: May 7, 2015

(65) Prior Publication Data

US 2015/0240549 A1 Aug. 27, 2015

Related U.S. Application Data

(63) Continuation of application No. 14/149,582, filed on Jan. 7, 2014, now Pat. No. 9,038,340.

(60) Provisional application No. 61/750,199, filed on Jan. 8, 2013.

(51) Int. Cl.

| | |
|---|---|
| ***E04F 19/04*** | (2006.01) |
| ***E06B 1/04*** | (2006.01) |
| ***B44C 5/00*** | (2006.01) |
| ***E04F 19/02*** | (2006.01) |

(52) U.S. Cl.

CPC ... *E06B 1/04* (2013.01); *B44C 5/00* (2013.01); *E04F 19/02* (2013.01); *Y10T 428/24174* (2015.01); *Y10T 428/24777* (2015.01)

(58) Field of Classification Search

CPC ..... E04F 15/02; E04F 13/06; B44C 5/0446; B44C 3/123

USPC ..... 52/311.1, 311.2, 287.1, 288.1, 27, 211; 428/38, 81, 119, 192; 40/107, 539, 40/561; 248/309.1, 682

See application file for complete search history.

(56) References Cited

U.S. PATENT DOCUMENTS

| | | | |
|---|---|---|---|
| D116,049 | S | 8/1939 | Noth |
| 2,369,988 | A | 2/1945 | Steckler et al. |
| 3,580,192 | A | 5/1971 | Davidson |
| 4,821,437 | A | 4/1989 | Abramson et al. |

(Continued)

OTHER PUBLICATIONS

Bolinger, P., et al., "Carving Seasonal Decorations for Windows & Door Frames," 1999, Book Cover and Book Description on Amazon.com, Shiffer Publishing Ltd, 4 pages.

*Primary Examiner* — Beth Stephan

(74) *Attorney, Agent, or Firm* — Slater Matsil, LLP

(57) ABSTRACT

In an embodiment, an interchangeable corner hanger to ornament framing protruding corner structures is provided. The interchangeable corner hanger includes a horizontal portion and a vertical portion. The horizontal portion is designed to rest on an exposed edge of a corner structure, and the vertical portion is designed to hang over the corner of the corner structure and rest against a wall upon which the trim is attached. The vertical portion has a length sufficient to stabilize the corner hanger without the use of other adhesives or attachments. In an embodiment, the vertical portion is configured to allow one or more interlocking elements to be suspended from the vertical portion. For example, the vertical portion may include an interlocking pattern configured to accept a complimentary interlocking pattern on an interlocking element. Further interlocking elements may be attached to the interlocking element.

18 Claims, 17 Drawing Sheets

(56) References Cited

U.S. PATENT DOCUMENTS

| | | | |
|---|---|---|---|
| 5,257,472 | A | 11/1993 | Harnois et al. |
| 5,306,535 | A | 4/1994 | Shaffer |
| 5,408,775 | A | 4/1995 | Abramson et al. |
| 5,411,780 | A | 5/1995 | Kaefer |
| 5,477,645 | A | 12/1995 | Bauer |
| 5,642,819 | A | 7/1997 | Ronia |
| 5,662,753 | A | 9/1997 | Loos |
| 5,945,180 | A | 8/1999 | Phillips |
| 6,070,744 | A | 6/2000 | Levinson et al. |
| 6,108,955 | A | 8/2000 | Folsom et al. |
| 6,185,883 | B1 | 2/2001 | Howard |
| 6,303,195 | B1 | 10/2001 | Reynolds et al. |
| 6,363,645 | B1 | 4/2002 | Hunter |
| 6,385,926 | B1 | 5/2002 | Kizar |
| 6,425,581 | B1 | 7/2002 | Barrett |
| 6,491,219 | B2 | 12/2002 | Brentini |
| 6,519,868 | B1 | 2/2003 | Pryor et al. |
| 7,103,983 | B2 | 9/2006 | Lehavi |
| 7,770,301 | B1 | 8/2010 | Grandberry et al. |
| 2004/0060251 | A1 | 4/2004 | Pamplin |
| 2005/0000068 | A1 | 1/2005 | Waszak et al. |
| 2005/0161569 | A1 | 7/2005 | Roberts |
| 2006/0183397 | A1 | 8/2006 | Kanahele et al. |
| 2007/0220795 | A1 | 9/2007 | Demaurex |
| 2008/0245751 | A1 | 10/2008 | Moran |
| 2011/0008572 | A1 | 1/2011 | Dayton |
| 2011/0031369 | A1 | 2/2011 | Kacines |
| 2012/0144624 | A1 | 6/2012 | Swartz |
| 2012/0280450 | A1 | 11/2012 | Knell et al. |

DEVICE FOR ENHANCING A CORNER STRUCTURE

This application is a continuation application of U.S. patent application Ser. No. 14/149,582, filed Jan. 7, 2014, entitled "Device for Enhancing a Corner Structure," which claims the benefit of U.S. Provisional Application Ser. No. 61/750,199, filed on Jan. 8, 2013, entitled "Device for Enhancing a Corner Structure," which application is hereby incorporated herein by reference.

TECHNICAL FIELD

This invention relates generally to building structures and, more particularly, to interchangeable devices to ornament framing structures.

BACKGROUND

Generally, framing structures, such as doors and windows, have a decorative piece of trim nailed into place. The trim services to cover the gap between the wall and the framing structure, thereby providing a more aesthetically pleasing appearance. While the trim is more aesthetically pleasing, many times it is desirable to provide different appearances.

One solution to this is to replace the trim as desired. This solution, however, is difficult and time-consuming. Replacing the trim requires the trim to be cut to the precise size, nailing the trim in place, caulking the joints, and painting the trim and wall surfaces.

Another solution is placing a wallpaper-type border around the trim. This solution involves affixing a decorative strip with an adhesive. While this solution provides a decorative border, changing or removing the wallpaper-type border may also be difficult and time-consuming as the wallpaper-type border is affixed by glue.

Yet another solution is to paint a decorative scene directly on the wall itself around the trim. This solution is time-consuming to put up in the first place as well as replacing it. This solution may also be expensive if it is necessary to hire a painter to create the painting.

SUMMARY

These and other problems are generally reduced, solved or circumvented, and technical advantages are generally achieved, by embodiments of the present invention, which provides interchangeable devices to ornament a framing structure.

In an embodiment, interchangeable corner hanger devices to ornament protruding corner structures are provided. The interchangeable corner hanger devices include a horizontal portion and a vertical portion. The horizontal portion is designed to rest on an exposed edge of the corner structure, and the vertical portion is designed to hang over the corner structure and rest against a wall upon which the corner structure is attached. The vertical portion has a length sufficient to stabilize the corner hanger without the use of other adhesives or attachments. Additionally, the vertical portion includes an interlocking pattern to allow one or more interlocking elements to be suspended from the vertical portion.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
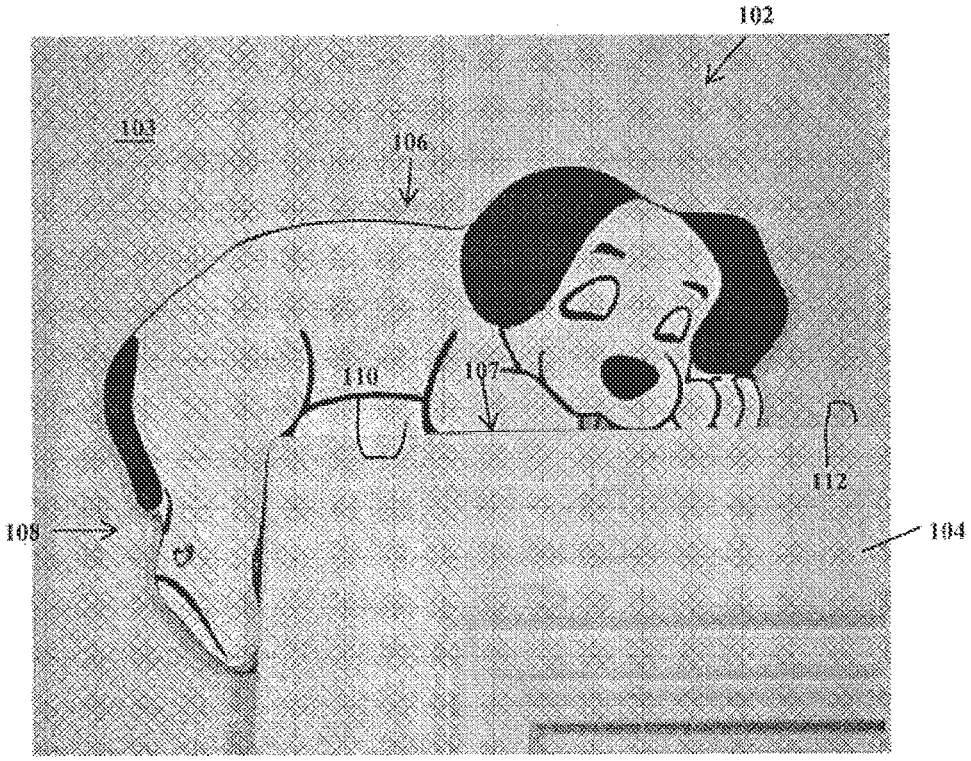
FIGS. 1-17 illustrate embodiments of corner hangers having various shapes.

FIG. 1 illustrates an interchangeable corner hanger 102 placed on a corner structure 104 protruding from a supporting wall 103 in accordance with an embodiment, wherein the corner hanger 102 is shaped as a dog such that the leg of the dog hangs over a corner of the corner structure 104 to provide stability. In this embodiment, the corner structure 104 is illustrated as trim around a doorway for illustrative purposes only. In other embodiments, the corner structure 104 may be trim around a window, a mirror, a light plate switch, or the like.

The corner hanger 104 may be formed of any suitable material, such as wood, plastic, or the like, and be of any suitable thickness. In an embodiment in which the corner structure 104 is trim around a doorway, the corner hanger 102 is formed of wood having a thickness of about one-eighth of an inch.

The corner hanger 102 has a horizontal portion 106 and a vertical portion 108. The horizontal portion 106 has one or more contact points 107 designed to rest upon an upper surface 112 of the corner structure 104. While the embodiment illustrated in FIG. 1 illustrates that substantially all of a bottom surface 110 of the corner hanger 102 contacts the upper surface 112 of the corner structure 104, in other embodiments, portions of the bottom surface 110 may have multiple contact points such that not all of the bottom surface 110 contacts the upper surface 112 of the corner structure 104.

The vertical portion 108 extends over a corner of the corner structure 104 and provides stability and balance to the corner hanger 102, allowing the corner hanger 102 to stay in place without need of fasteners, such as glue, Velcro, nails, screws, or the like. By extending a portion of the corner hanger 102 over the corner of the corner structure 104 in the manner illustrated in FIG. 1, the center of gravity is effectively lowered relative to the upper surface 112 of the corner structure 104. It has been found that in this manner, it allows the corner hanger 102 to remain in place, even over a door trim with the door being repeatedly slammed shut. Without the vertical portion 108, the center of gravity would be considerably higher and provides a much less stable structure. In an embodiment, the center of gravity is lower than about two inches above the upper surface 112 of the corner structure 104. For example, in an embodiment, the center of gravity is lower than the upper surface 112 of the corner structure 104.

The vertical portion 108 may further rest against the supporting wall 103, such that the supporting wall 103 provides an anti-tipping effect. As can be appreciated, a structure comprising only the horizontal portion has a fulcrum or point of rotation along a joint between the contact points 107 and the upper surface 112 of the corner structure 104 and, as a result, could easily tip over. The vertical extension of the vertical portion 108, however, restricts the tipping motion, because as the horizontal portion 106 tips, the vertical portion 108 is "pushed into" the wall. In this manner, as the wall prevents the vertical portion 108 from rotating into the wall, the horizontal portion 106 is prevented from tipping over.

It should be appreciated that the larger the vertical portion 108 is relative to the horizontal portion 106, the more stable the corner hanger 102 may be. Further, it should be noted that the vertical height of the horizontal portion 106 also affects the stability, wherein the greater the vertical height of the horizontal portion 106, the less stable. Accordingly, the greater the vertical height of the horizontal portion 106, it may be desirable to increase the size of the vertical portion 108.

Embodiments of the corner hanger 102 may be easily replaced to provide different themes to a room. For example, seasonal themes may be used for Valentine's Day, Easter, Christmas, Halloween, Fourth of July, Thanksgiving, and the like, throughout the year.

Figure 2:
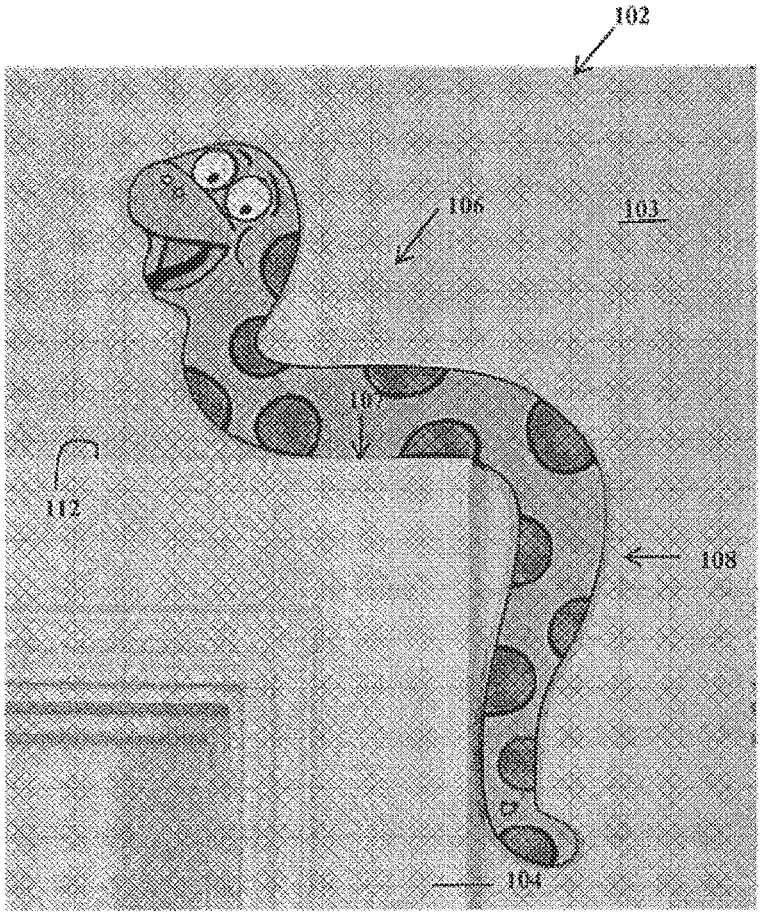

FIGS. 2-11 are examples of types of corner hangers that may be used in accordance with various embodiments. Referring first to FIG. 2, the corner hanger 102 has a shape of a snake, wherein the head of the snake is elevated above the upper surface 112 of the corner structure 104. Further, FIG. 2 illustrates that the entirety of the vertical portion 108 does not necessarily rest against the corner structure. For example, the curve of the snake around the corner of the corner structure 104 extends past the corner, thereby leaving a gap between the corner structure 104 and the corner hanger 102. The lower portion of the snake rests against the trim, thereby aiding in providing a solid, stable base.

Figure 3:
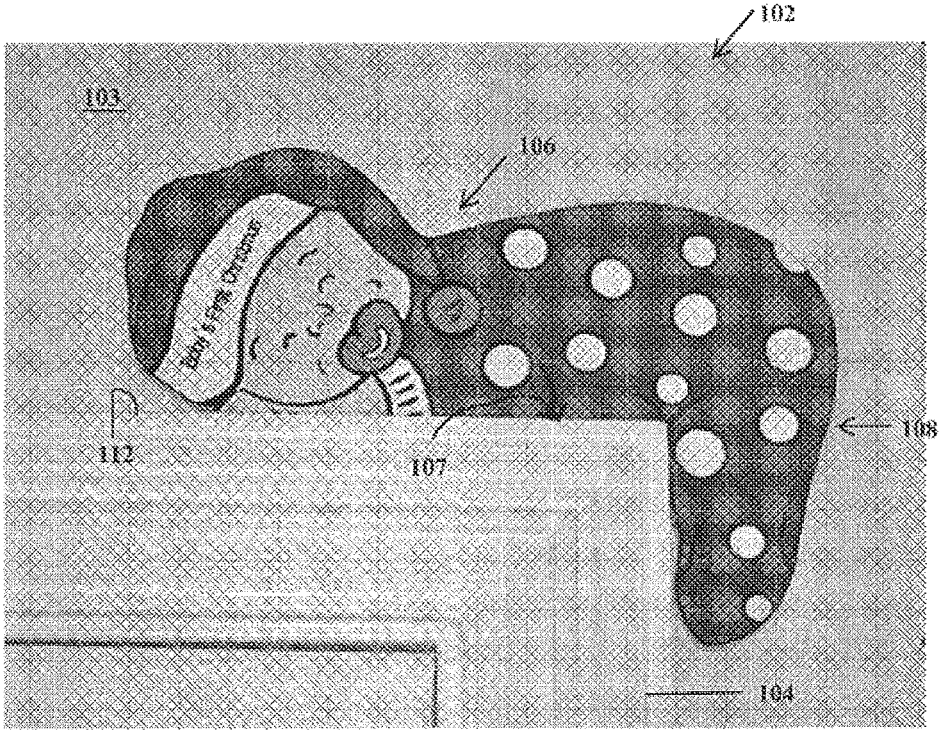

In FIG. 3, the corner hanger 102 has a shape of a sleeping baby, wherein a head and body of the sleeping baby rests on the upper surface 112 of the corner structure 104, and feet of the sleeping baby hang over the corner of the corner structure 104 to provide stability.

Figure 4:
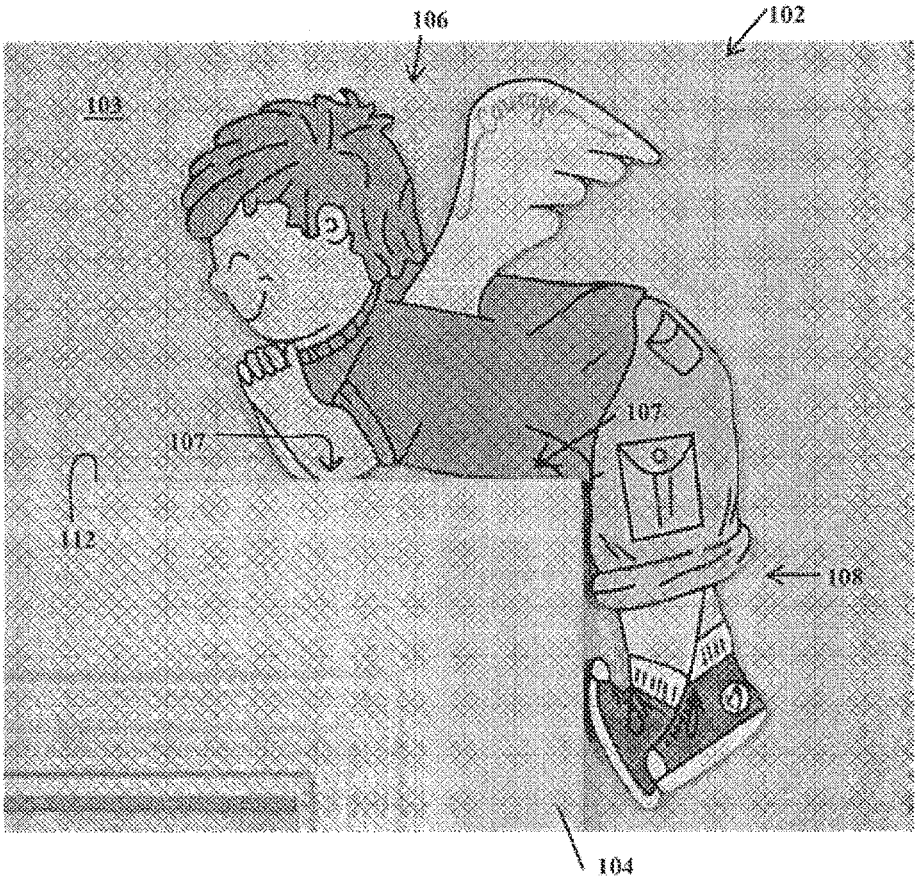

FIG. 4 illustrates the corner hanger 102 shaped as a boy with angel wings. Similar to the embodiment illustrated in FIG. 3, the legs hang over the corner of the corner structure 104 to provide support. FIG. 4 also illustrates an embodiment in which multiple contact points 107 are used for the interface between the horizontal portion 106 and the corner structure 104.

Figure 5:
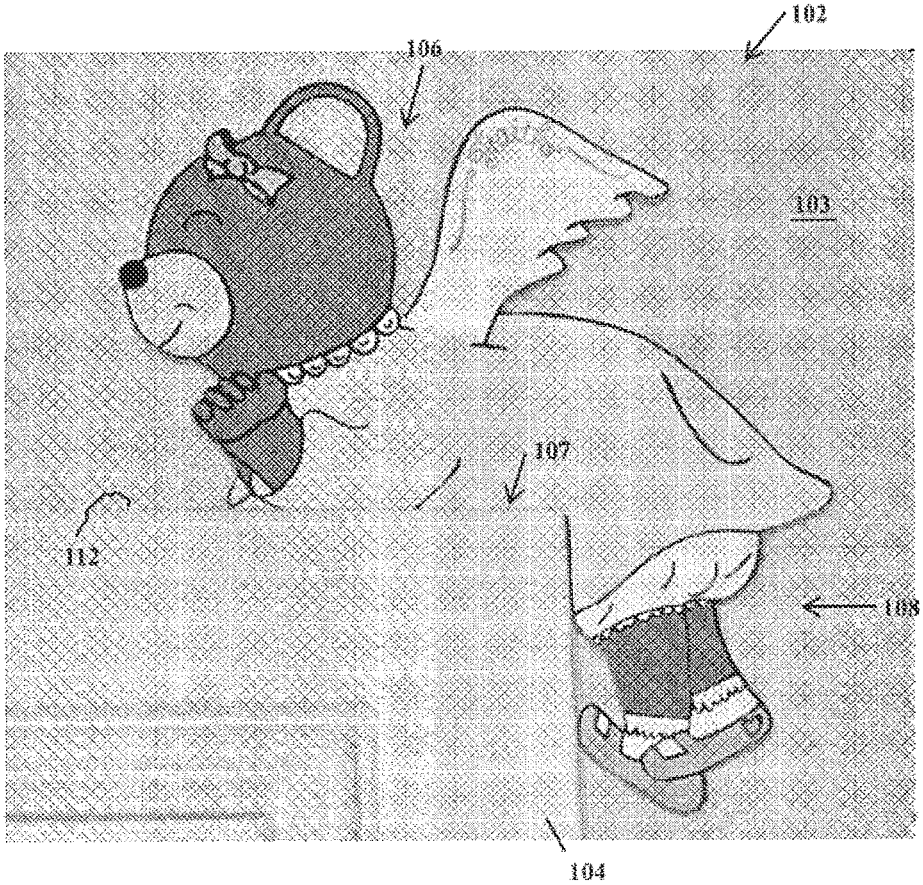
Figure 6:
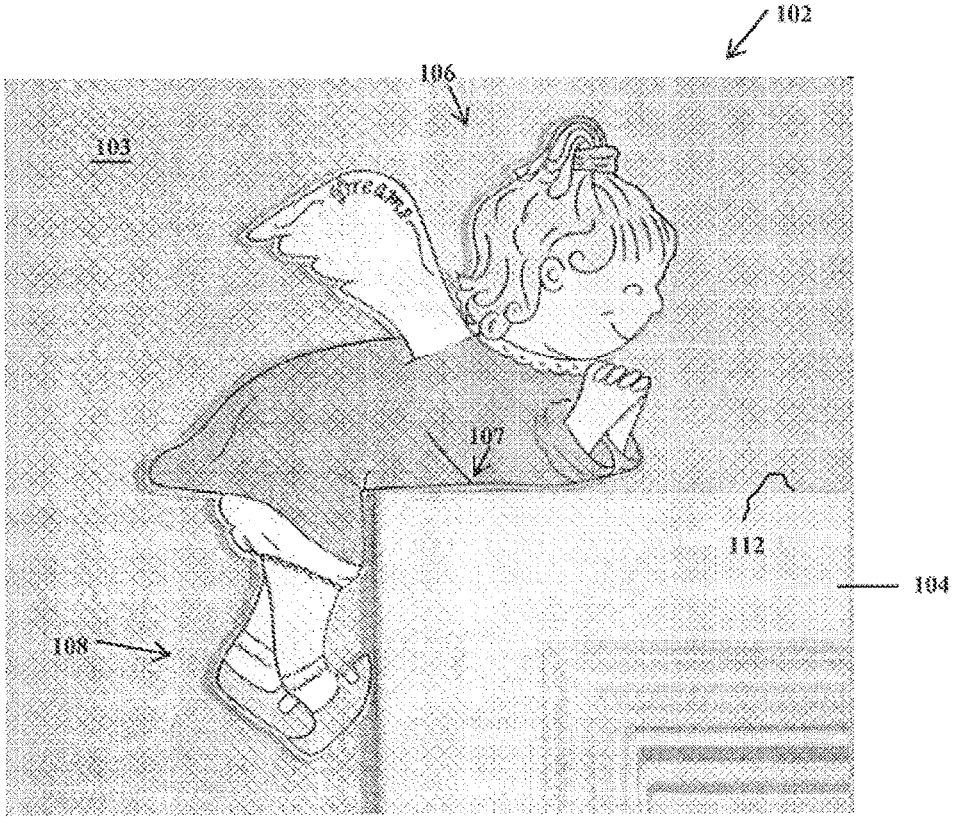

FIGS. 5 and 6 illustrate the corner hanger 102 as a bear and a girl, respectively, with angel wings. Similar to the embodiment illustrated in FIG. 4, the legs hang over the corner of the corner structure 104 to provide support.

Figure 7:
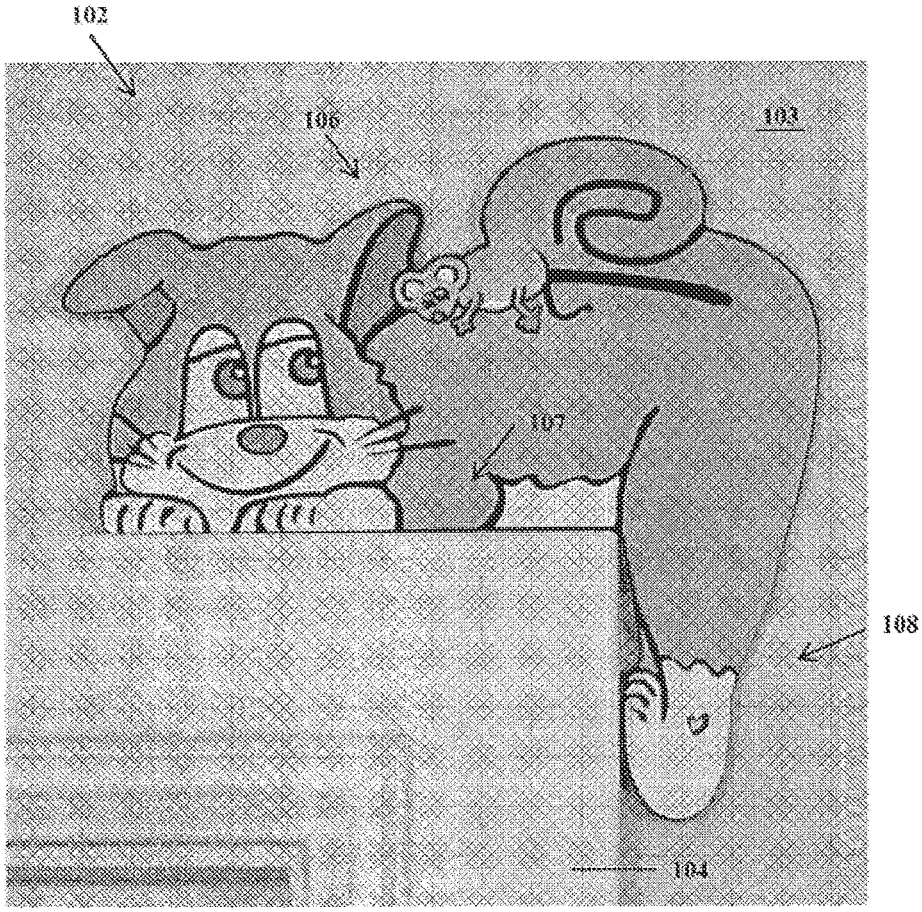
Figure 8:
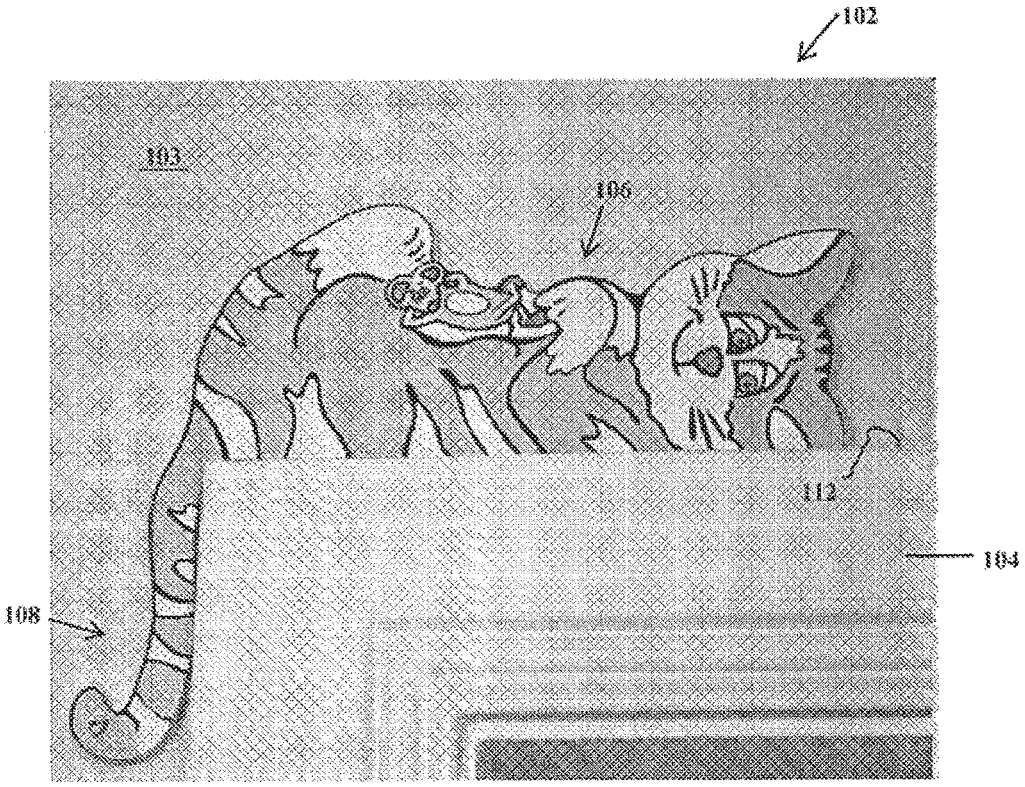

FIGS. 7 and 8 illustrate various corner hangers of a cat, wherein FIG. 7 is illustrated to hang from the right side and FIG. 8 is designed to hang from the left side. It should also be noted that the vertical portion of the cat in FIG. 7 comprises the back legs of the cat, while the vertical portion of the cat in FIG. 8 comprises the tail.

Figure 9:
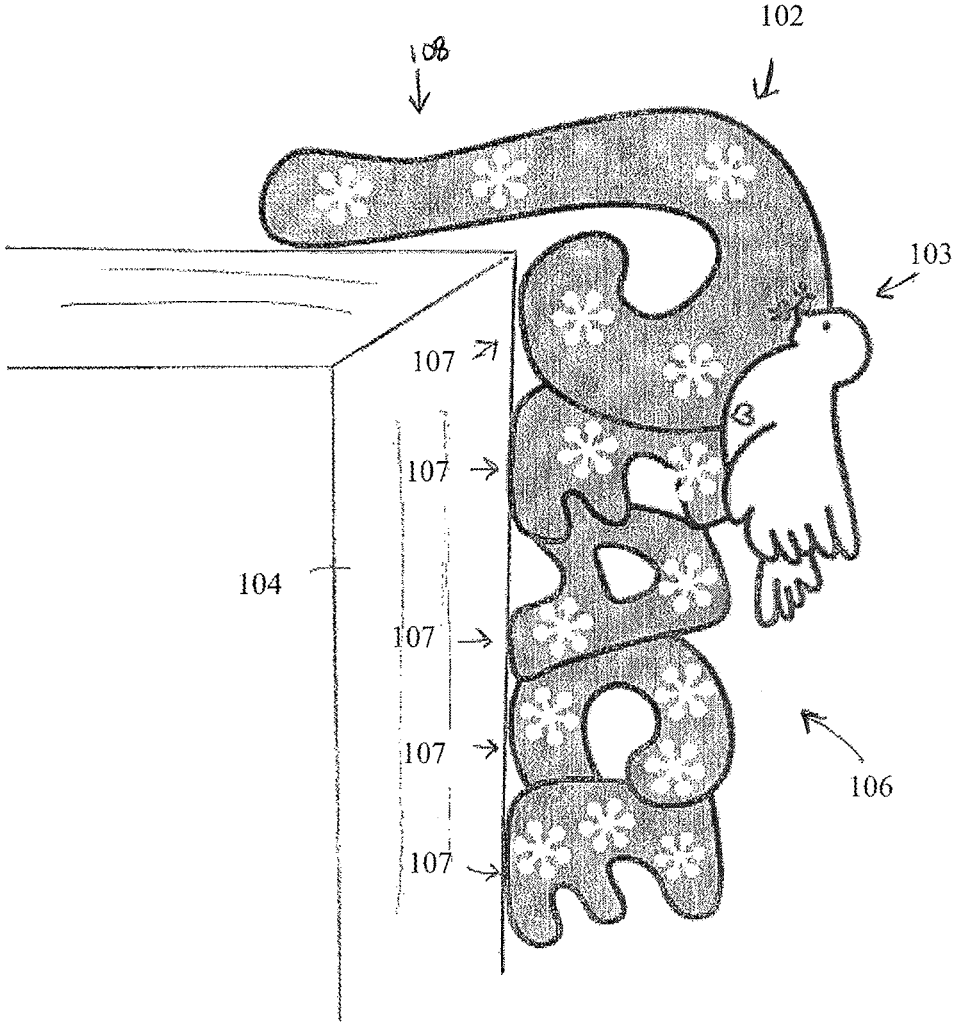
Figure 10:
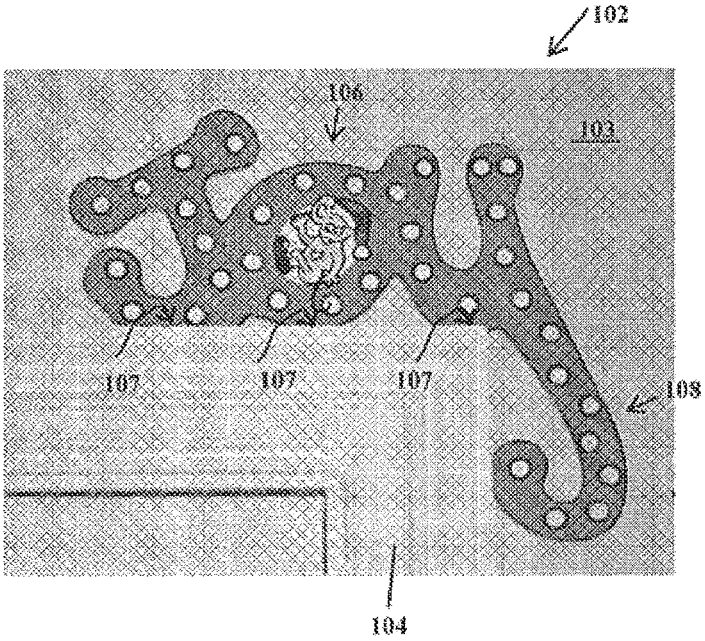

FIGS. 9 and 10 illustrate that embodiments of the corner hanger 102 may use shapes or configurations other than animals or people. For example, in the embodiment illustrated in FIG. 9, the word "Peace" is used, wherein the "P" hangs over the edge to provide stability. FIG. 9 further illustrates that a flat edge is not necessarily present to rest against the top surface of the corner structure 104. FIG. 10 illustrates a similar embodiment in which the corner hanger 102 is shaped as the word "Joy," wherein the "y" hangs over the corner of the corner structure 104. In these embodiments, the corner hanger has multiple points of contact.

Figure 11:
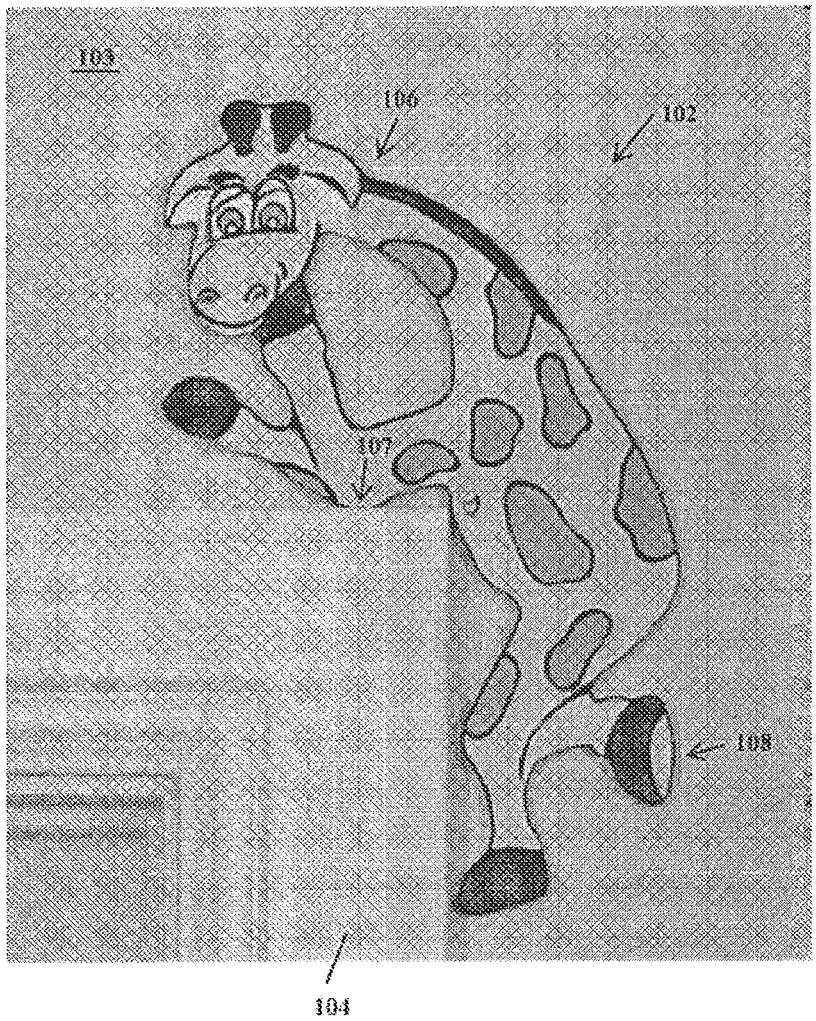

FIG. 11 illustrates the corner hanger 102 shaped as a giraffe. In this embodiment, the corner hanger 102 is designed such that the vertical portion 108 of the corner hanger 102 contacts the corner structure 104 to keep the corner hanger 102 from rotating and swinging off of the corner structure 104. In particular, the single, relatively small, contact point 107 of the giraffe acts as a point of rotation aided by the weight of the giraffe's body hanging over the corner of the corner structure. The giraffe rotates thus until the one or more portions of the vertical portion 108 of the giraffe contacts the corner structure 104.

Figure 12:
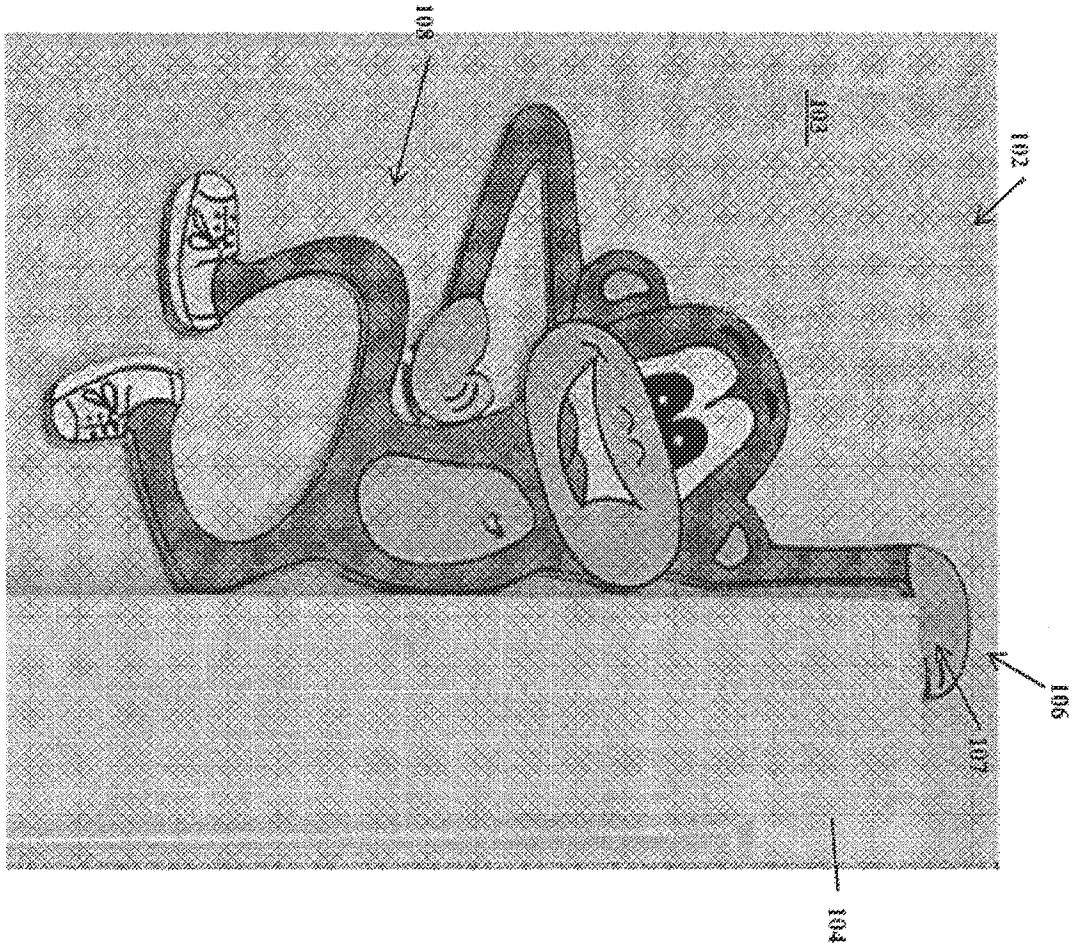
Figure 13:
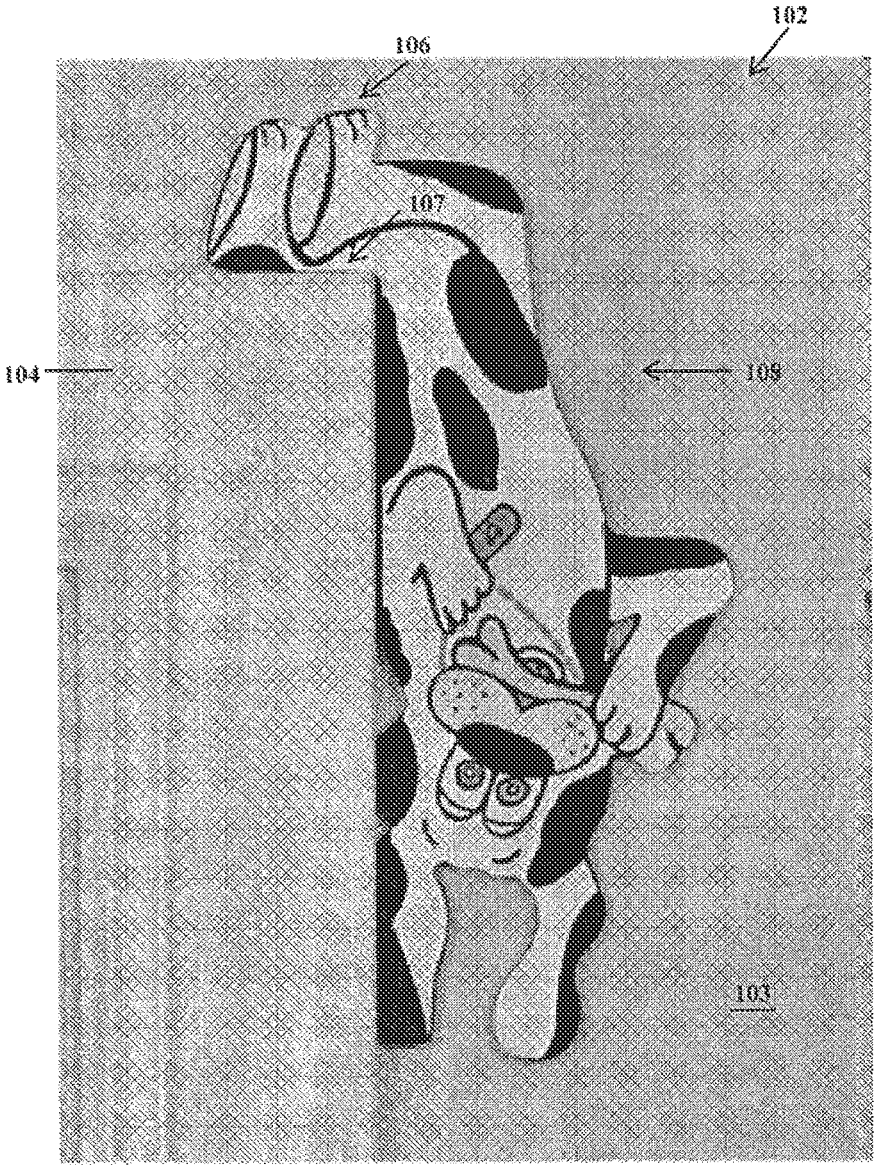
Figure 14:
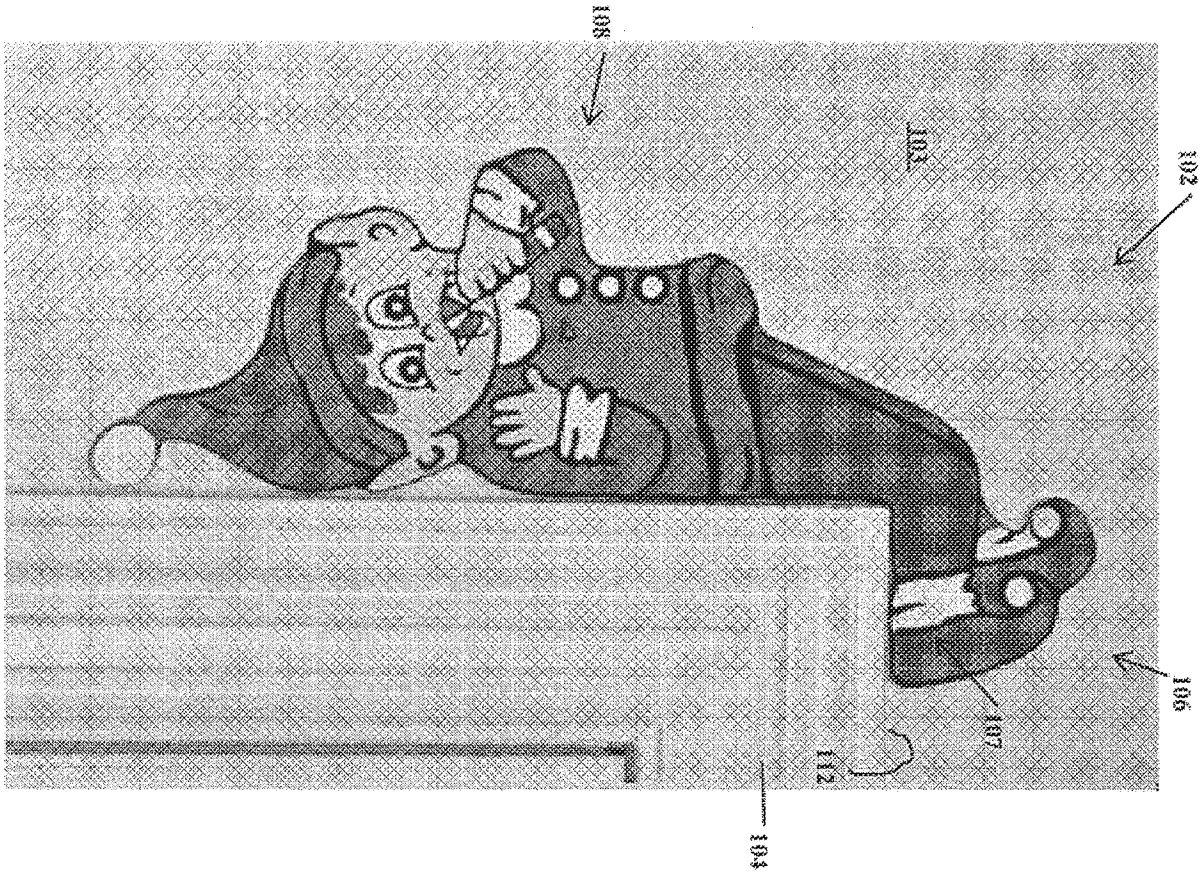

FIGS. 12-14 illustrate embodiments of the corner hanger 102 wherein the horizontal portion 106 is small compared to the overall size of the corner hanger 102. For example, in FIG. 12, the horizontal portion 106 comprises only a hand of a monkey, while remaining portions of the body of the monkey hang over the corner of the corner structure 104. Similarly, in FIG. 13, the dog is hanging by only the lower portions of the back legs of the dog, and in FIG. 14, an elf hangs only by the lower legs.

In embodiments such as those illustrated in FIGS. 11-14, the center of gravity is sufficiently close to the vertical surface of the corner structure 104 such that the corner hanger 102 does not rotate off the corner structure 104. For example, in an embodiment the center of gravity is within two inches of the vertical surface of the corner structure 104.

Figure 15:
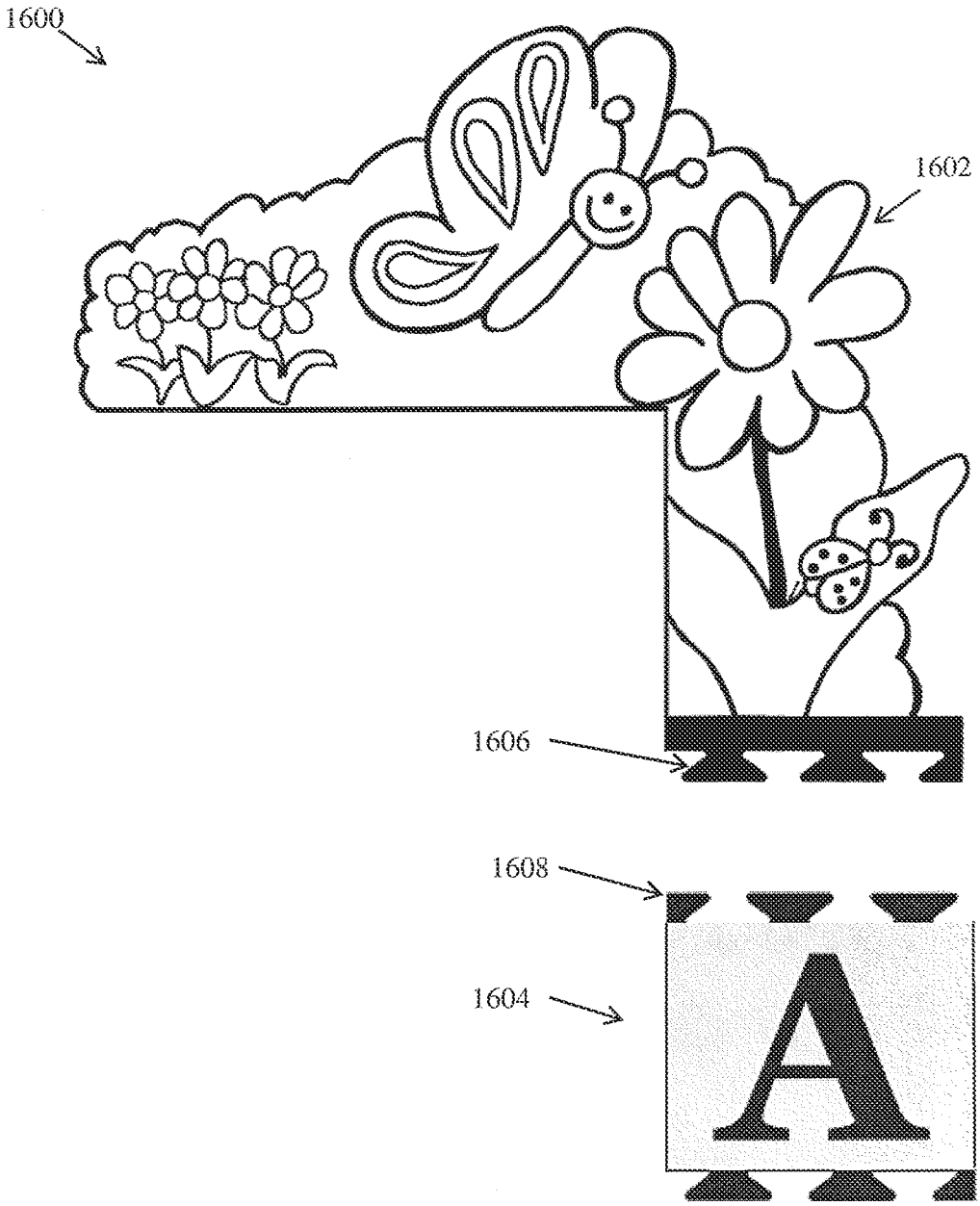
Figure 16:
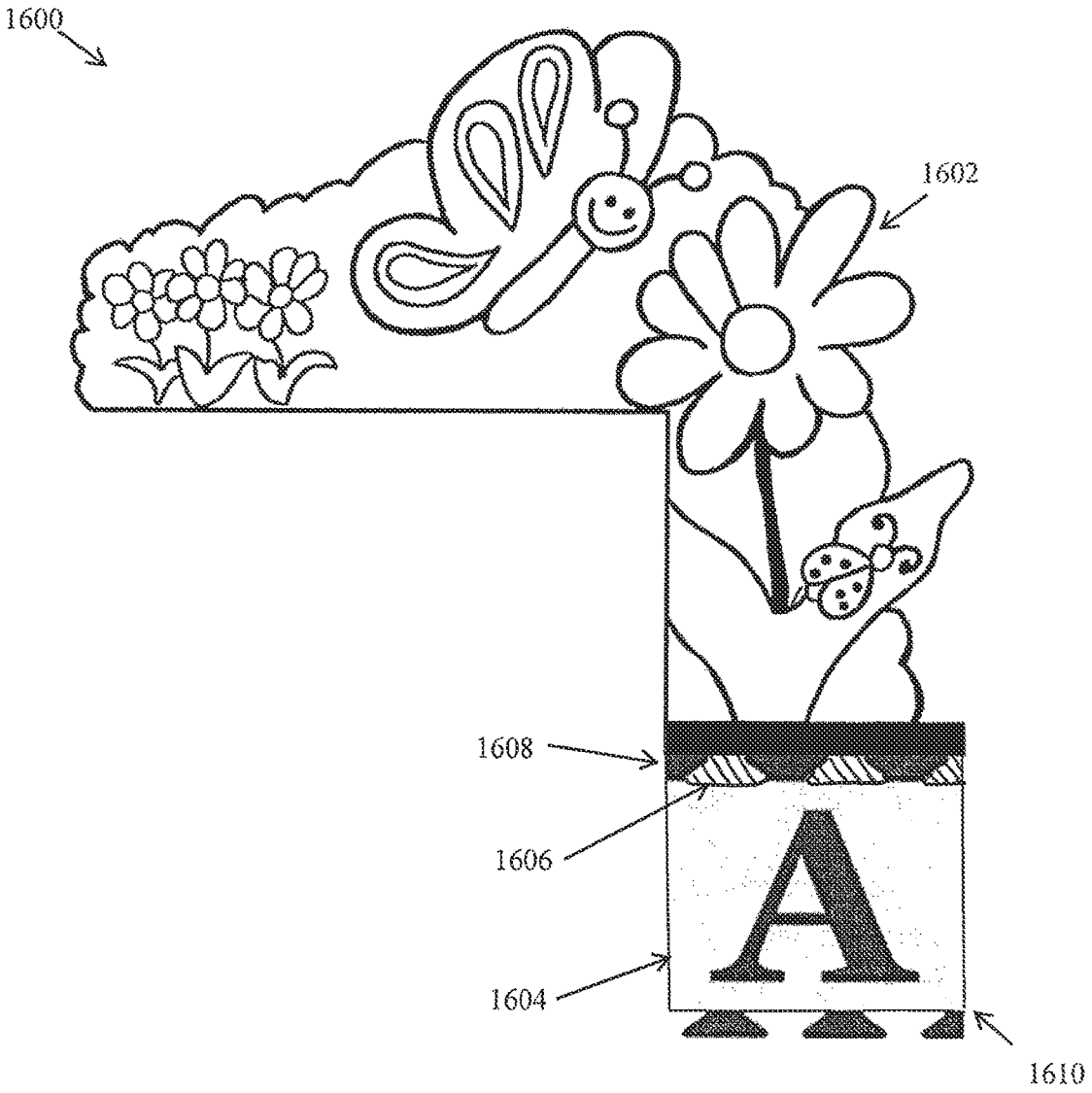
Figure 17:
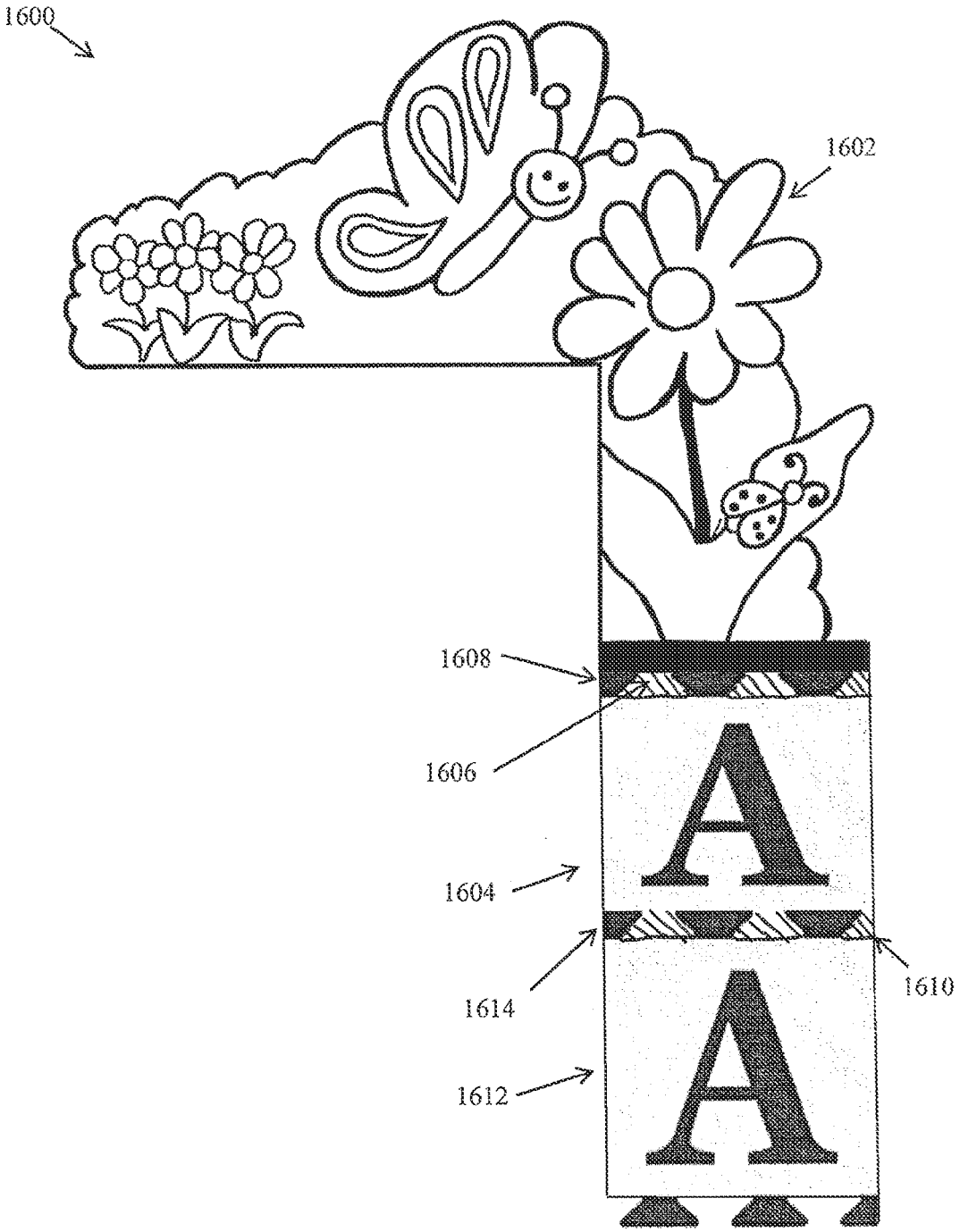

FIGS. 15-17 illustrate an embodiment of a corner hanger including one or more suspended interchangeable elements. For example, the corner hanger 1600 includes a support portion 1602 and one or more interlocking elements, illustrated in FIG. 15 by an interlocking element 1604. The support portion 1602 may exhibit characteristics as discussed above in addition to a first interlocking pattern 1606. The first interlocking pattern 1606 is designed to accept the interlocking element 1604, thereby supporting or suspending the interlocking element 1604 from the support portion 1602. For example, as illustrated in FIG. 15, the first interlocking pattern 1606 is complimentary to a second interlocking pattern 1608 included on the interlocking element 1604. FIG. 16 illustrates the support element 1602 connected to the interlocking element 1604, wherein the first interlocking pattern 1606 has been illustrated with cross-hatching to distinguish from the second interlocking pattern 1608 for illustrative purposes.

While FIGS. 15 and 16 illustrate one interlocking element 1604 for illustrative purposes, other embodiments may utilize two or more interlocking elements. For example, FIG. 17 illustrates an embodiment in which the interlocking element 1604 may further include an interlocking pattern, such as a third interlocking pattern 1610. The use of the third interlocking pattern 1610 on the interlocking element 1604 allows further shapes, patterns, letters, phrases, or other features to be suspended from the interlocking element 1604, such as interlocking element 1612 having a fourth interlocking pattern 1614 complimentary to the third interlocking pattern 1610, wherein the first interlocking pattern 1606 and the third interlocking pattern 1610 have been illustrated with cross-hatching to distinguish from the second interlocking pattern 1608 and the fourth interlocking pattern 1610 for illustrative purposes.

The use of the first interlocking pattern 1606 and the second interlocking pattern 1608 allow the patterns suspended from the support portion 1602 to be interchanged. For example, different words, phrases, and/or different shapes (e.g., fish, birds, characters, etc.) may be suspended as desired for different times of the year (e.g., Valentine's Day, Christmas, Halloween), events (e.g., birthdays), and the like.

Although the present invention and its advantages have been described in detail, it should be understood that various changes, substitutions and alterations can be made herein without departing from the spirit and scope of the invention as defined by the appended claims. For example, other types of interlocking patterns may be used, as well as other types of connectors, such as hooks, eye-hooks, or the like. Furthermore, the interlocking patterns may be hidden, such as a snap or interlocking pattern behind the top element. This embodiment may have a further embodiment of hiding the interlocking pattern from view as well as the interlocking pattern being hidden on the bottom element.

Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus for a corner structure, the corner structure having a horizontal surface and a vertical surface, the apparatus comprising:

a base element having a horizontal portion, a vertical portion connected to the horizontal portion, and a first interlocking pattern connected to the vertical portion, the horizontal portion having one or more first contact points for contacting the horizontal surface of the corner structure, the vertical portion having one or more second contact points for contacting the vertical surface of the corner structure, the first interlocking pattern having a plurality of first projections; and an interlocking element having a second interlocking pattern, the first interlocking pattern and the second interlocking pattern being complementary patterns, the first interlocking pattern and the second interlocking pattern being configured such that the base element suspends the interlocking element.

2. The apparatus of claim 1, wherein the corner structure comprises is a 90-degree corner.

3. The apparatus of claim 1, wherein the apparatus has a center of gravity lower than a bottom surface of the horizontal portion when the horizontal portion rests on top of the corner structure.

4. The apparatus of claim 1, wherein the base element has a center of gravity lower than two inches above the one or more contact points of the horizontal portion when the horizontal portion rests on top of the corner structure.

5. The apparatus of claim 1, wherein the apparatus has one or more contact points bearing on a supporting wall.

6. The apparatus of claim 1, wherein the interlocking element further comprises a third interlocking pattern configured to accept another interlocking element.

7. An apparatus for a corner structure, the corner structure having a horizontal surface and a vertical surface, the apparatus comprising:

a base element having a horizontal portion, a vertical portion connected to the horizontal portion, and a first interlocking pattern connected to the vertical portion, the horizontal portion having a plurality of contact points for contacting and being supported by a top surface of the horizontal surface of the corner structure, the first interlocking pattern having a plurality of first projections; and an interlocking element having a second interlocking pattern, the first interlocking pattern and the second interlocking pattern being complementary patterns, the first interlocking pattern and the second interlocking pattern being configured such that the base element suspends the interlocking element.

8. The apparatus of claim 7, wherein the interlocking element further comprises a third interlocking pattern configured to accept another interlocking element.

9. The apparatus of claim 7, wherein the corner structure comprises is a 90-degree corner.

10. The apparatus of claim 7, wherein the apparatus has a center of gravity lower than a bottom surface of the horizontal portion when the horizontal portion rests on top of the corner structure.

11. The apparatus of claim 7, wherein the base element has a center of gravity lower than two inches above the one or more contact points of the horizontal portion when the horizontal portion rests on top of the corner structure.

12. The apparatus of claim 7, wherein the apparatus has one or more contact points bearing on a supporting wall.

13. A method of forming an apparatus for a corner structure, the corner structure having a horizontal surface and a vertical surface, the method comprising:

forming a base element having a horizontal portion, a vertical portion connected to the horizontal portion, and a first interlocking pattern connected to the vertical portion, the horizontal portion having a plurality of contact points for contacting and being supported by a top surface of the horizontal surface of the corner structure, the first interlocking pattern having a plurality of first projections; and forming an interlocking element having a second interlocking pattern, the first interlocking pattern and the second interlocking pattern being complementary patterns, the first interlocking pattern and the second interlocking pattern being configured such that the base element suspends the interlocking element.

14. The method of claim 13, wherein the interlocking element comprises a third interlocking pattern configured to accept another interlocking element.

15. The method of claim 13, wherein the structure is a 90-degree corner.

16. The method of claim 13, wherein the base element has a center of gravity lower than a bottom surface of the horizontal portion when the horizontal portion rests on top of the corner structure.

17. The method of claim 13, wherein the base element has a center of gravity lower than two inches above a bottom surface of the horizontal portion when the horizontal portion rests on top of the corner structure.

18. The method of claim 13, wherein the vertical portion has one or more contact points bearing on the vertical surface of the corner structure.

* * * * *